US007365693B2

(12) United States Patent
Hoshiai et al.

(10) Patent No.: US 7,365,693 B2
(45) Date of Patent: Apr. 29, 2008

(54) ANTENNA DEVICE, ELECTRONIC APPARATUS AND VEHICLE USING THE SAME ANTENNA DEVICE

(75) Inventors: Akihiro Hoshiai, Osaka (JP); Susumu Fukushima, Osaka (JP); Yosuke Wada, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 3 days.

(21) Appl. No.: 11/528,038

(22) Filed: Sep. 26, 2006

(65) Prior Publication Data

US 2007/0069964 A1 Mar. 29, 2007

(30) Foreign Application Priority Data

Sep. 29, 2005 (JP) ..... 2005-284337
Feb. 7, 2006 (JP) ..... 2006-029363

(51) Int. Cl.
*H01Q 1/32* (2006.01)

(52) U.S. Cl. ..... 343/711; 343/713; 343/700 MS

(58) Field of Classification Search ..... 343/711, 343/713

See application file for complete search history.

(56) References Cited

U.S. PATENT DOCUMENTS 5,418,543 A * 5/1995 Bolton ..... 343/713
6,809,692 B2 * 10/2004 Puente Baliarda et al. . 343/713
6,842,141 B2 * 1/2005 Suh et al. ..... 343/700 MS
2005/0088344 A1 * 4/2005 Saitou et al. ..... 343/700 MS
2006/0152412 A1 * 7/2006 Evans et al. ..... 343/700 MS
2006/0170604 A1 * 8/2006 Almog et al. ..... 343/795

FOREIGN PATENT DOCUMENTS

JP 2005-130292 5/2005

* cited by examiner

*Primary Examiner*—Trinh Vo Dinh
(74) *Attorney, Agent, or Firm*—RatnerPrestia

(57) ABSTRACT

An antenna device includes a grounding subject, a feeder insulated from the grounding subject, a first conductor shaping like substantially a looped triangle and coupled to the feeder at a first feeder top, and a second conductor symmetric to the first conductor with respect to a phantom line extending through the feeder and coupled to the feeder at a second feeder top. The first feeder top is placed closest to the grounding subject among other elements of the first conductor, and the second feeder top is placed closest to the grounding subject among other elements of the second conductor. The foregoing structure allows a high electrical field section of a first side of the first conductor and that of a first side of the second conductor to leave further away from the grounding subject.

9 Claims, 6 Drawing Sheets

ANTENNA DEVICE, ELECTRONIC APPARATUS AND VEHICLE USING THE SAME ANTENNA DEVICE

FIELD OF THE INVENTION

The present invention relates to antenna devices for receiving signals, and it also relates to electronic apparatuses and vehicles both using the same antenna devices.

BACKGROUND OF THE INVENTION

Unexamined Japanese Patent Publication No. 2005-130292 discloses one of conventional antenna devices. This one is a balanced antenna detailed hereinafter with reference to FIG. 9.

Conventional antenna device 1 shown in FIG. 9 comprises the following elements:

(1) grounding subject 2;
(2) feeder 3 insulated from grounding subject 2;
(3) first feeding line 4 and second feeding line 5 both extending from feeder 3 along the direction leaving away from grounding subject 2;
(4) first conductor 7 shaping like a looped triangle and coupled to first feeding line 4 at first feeder top 6; and
(5) second conductor 9 coupled to second feeding line 5 at second feeder top 8.

First conductor 7 and second conductor 9 are symmetrically placed with respect to a phantom line extending through feeder 3.

First conductor 7 is formed of the following elements:

(4-1) first side 10 extending from first feeder top 6 toward the outside of antenna device 1 while approaching grounding subject 2;
(4-2) second side 11 extending from first feeder top 6 toward the outside of antenna device 1 while leaving away from grounding subject 2 further than first side 10; and
(4-3) third side 12 coupled to the second end of first side 10 as well as the second end of second side 11. (the first ends of first side 10 and second side 11 are respectively coupled to first feeder top 6)

Second conductor 9 is formed of the following elements similarly to the first conductor 7:

(5-1) first side 13 extending from second feeder top 8 toward the outside of antenna device 1 while approaching grounding subject 2;
(5-2) second side 14 extending from second feeder top 8 toward the outside of antenna device 1 while leaving away from grounding subject 2 further than first side 14; and
(5-3) third side 15 coupled to the second end of first side 13 as well as the second end of second side 14. (the first ends of first side 13 and second side 14 are respectively coupled to second feeder top 8)

First side 10 of first conductor 7 and the other first side 13 of second conductor 9, both of which are placed nearest to grounding subject 2 among other sides, approach grounding subject 2 while they extend toward the outside of antenna device 1. Since the electric field becomes higher as first sides 10 and 13 run further toward the outside of antenna device 1, first sides 10 and 13 are electro-magnetically coupled to grounding subject 2, so that the reflecting function of grounding subject 2 is obliged to lower. As a result, the directionality of the antenna device along the direction further away from grounding subject 2, namely, the directionality along the upward direction (along allow mark A) in FIG. 9 lowers.

Unexamined Japanese Patent Publication No. S62-31204 discloses another conventional antenna device. This one is a dipole antenna described hereinafter with reference to FIG. 10. Conventional antenna device 100 shown in FIG. 10 comprises the following elements:

(1) feeder 101;
(2) first conductor 102 coupled to feeder 101; and
(3) second conductor 103 symmetrically disposed to first conductor 102 with respect to a phantom line extending through feeder 101.

First conductor 102 is formed of the following elements:

(2-1) first side 107 coupled to feeder 101 at its first end; and
(2-2) first base 108 coupled substantially vertically to the second end of first side 107.

Second conductor 103 is formed of the following elements similarly to the first conductor 102:

(3-1) second side 113 coupled to feeder 101 at its first end; and
(3-2) second base 114 coupled substantially vertically to the second end of second side 113.

First side 107 is generally in parallel with second side 113.

Antenna device 100 discussed above, however, has only first base 108 and second base 114 as antenna elements for contributing to radiation, so that the antenna fractional bandwidth becomes narrow.

SUMMARY OF THE INVENTION

An antenna device of the present invention comprises the following elements:

a grounding subject;
a feeder insulated from the grounding subject;
a first conductor coupled to the feeder at a first feeder top and shaping like a looped triangle; and
a second conductor coupled to the feeder at a second feeder top and shaping symmetrically to the first conductor with respect to a phantom line extending through the feeder.

The first conductor includes the following elements:

a first side extending from the first feeder top;
a second side extending from the second feeder top and yet leaving further away from the grounding subject than the first side; and
a third side coupled to another end of the first side as well as to another end of the second side.

The second conductor includes the following elements:

a first side extending from the second feeder top;
a second side extending from the second feeder top and yet leaving further away from the grounding subject than the first side; and
a third side coupled to another end of the first side as well as to another end of the second side.

The first feeder top is placed closest to the grounding subject among other elements of the first conductor, and the second feeder top is placed closest to the grounding subject among other elements of the second conductor.

The structure discussed above makes both of the first sides of the first conductor and the second conductor leave further away from the grounding subject as they run toward the outside of the antenna device. In other words, the higher electric field sections of both of the first sides leave further away from the grounding subject. This structure can thus suppress the electromagnetic coupling between the grounding subject and both of the first sides, so that the grounding subject improves its reflecting function. As a result, the antenna directionality along the direction further away from the grounding subject can be improved.

DETAILED DESCRIPTION OF PREFERRED EMBODIMENTS

Embodiment 1

Figure 1:
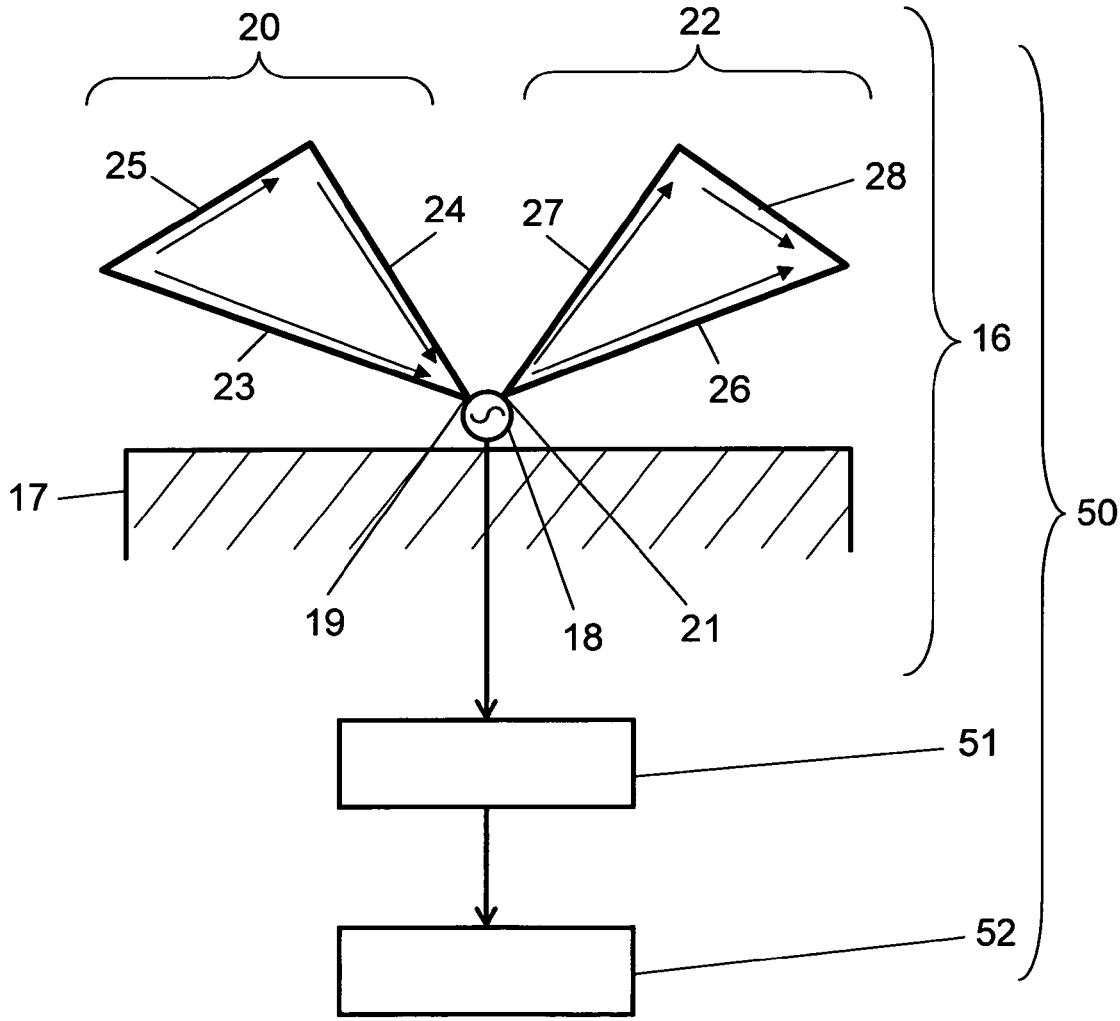
FIG. 1 shows a structure of an antenna device and an electric apparatus in accordance with a first embodiment of the present invention.

The first exemplary embodiment of the present invention is demonstrated hereinafter with reference to FIG. 1, which shows a structure of an antenna device and an electric apparatus in accordance with the first embodiment of the present invention. In FIG. 1, antenna device 16 is a balanced antenna comprising the following elements:

- conductive grounding subject 17 made of metal;
- feeder 18 insulated from grounding subject 17;
- first conductor 20 coupled to feeder 18 at first feeder top 19 and shaping like a looped triangle; and
- second conductor 22 coupled to feeder 18 at second feeder top 21 and symmetrically to first conductor 20 with respect to a phantom line extending through feeder 18.

First and second conductors 20, 22 are not planar but looped shape, i.e. a plane is punched out its center section, so that when antenna device 16 is affixed to the front windshield of a vehicle, users can get better front visibility than a case where a planar antenna is affixed. Electronic apparatus 50 employing this antenna device 16 includes radio circuit 51 coupled to feeder 18 and display section 52 coupled to radio circuit 51.

First conductor 20 includes the following elements:

- first side 23 of which first end extends from first feeder top 19;
- second side 24 of which first end extends from first feeder top 19 and yet which side 24 leaves further away from grounding subject 17 than first side 23; and
- third side 25 coupled to another end of first side 23 as well as to another end of second side 24.

Second conductor 22 includes the following elements:

- first side 26 extending from second feeder top 21;
- second side 27 extending from second feeder top 21 and yet leaving further away from grounding subject 17 than first side 26; and
- third side 28 coupled to another end of first side 26 as well as to another end of second side 27.

First feeder top 19 is placed closest to grounding subject 17 among other elements of first conductor 20, and second feeder top 21 is placed closest to grounding subject 17 among other element of second conductor 22.

An operation of the antenna device in accordance with the first embodiment in receiving a signal is demonstrated with reference to FIG. 1.

Feeder 18 feeds first conductor 20, so that a reception current, which helps with reception of signals, runs through first side 23, second side 24, and third side 25 respectively.

To be more specific, the reception current running through first side 23 runs from third side 23 toward first feeder top 19 as shown with the arrow marks in FIG. 1. The reception current running through first side 26 runs from second feeder top 21 toward third side 28. As such, antenna device 16 resonates at certain resonance frequency f1 due to the reception current running through first side 23 of first conductor 20 and first side 26 of the second conductor 22.

As shown the arrow marks in FIG. 1, the reception current running through third side 25 and second side 24 runs from the connecting point between first side 23 and third side 25 toward first feeder top 19 via the connecting point between third side 25 and second side 24. The reception current running through second side 27 and third side 28 runs from second feeder top 21 toward the connecting point between third side 28 and first side 26 via the connecting point between second side 27 and third side 28. As such, antenna device 16 resonates at certain resonance frequency f2 due to the reception current running through third side 25 and second side 24 of first conductor 20 as well as second side 27 and third side 28 of second conductor 22. Antenna device 16 thus has two different resonance frequencies f1 and f2, so that its antenna fractional bandwidth becomes wider.

The foregoing description refers to the operation of the antenna device in receiving signals; however, the description is applicable also to the operation in transmitting signals.

According to the foregoing structure, first side 23 placed closest to grounding subject 17 among other sides of first conductor 20 and first side 26 placed closest to grounding subject 17 among other sides of second conductor 22 leave further away from grounding subject 17 as these two sides run toward the outside of antenna device 16. In other words, the sections of higher electric field of these two sides leave further away from grounding subject 17. To be more specific, first feeder top 19 is placed closest to grounding subject 17 among the elements of first conductor 20, and second feeder point 21 is placed closest to grounding subject 17 among the elements of second conductor 22.

The structure discussed above, i.e. first feeder top 19 and second feeder top 21 are placed closest to grounding subject 17, allows suppressing the electromagnetic coupling between grounding subject 17 and first side 23 of first conductor 20 as well as first side 26 of second conductor 22. Grounding subject 17 can thus improve its reflecting function. As a result, the antenna directionality along the direction of leaving away from grounding subject 17 can be improved.

First conductor 20 and second conductor 22 can be symmetrical with respect to the plane, instead of the line, extending through feeder 18. In this case, antenna device 16 comprises the following elements:

grounding subject 17;

feeder 18 insulated from grounding subject 17;

first conductor 20 coupled to feeder 18 at first feeder top 19 of feeder 18 and shaping like a looped triangle; and second conductor 22 coupled to feeder 18 at second feeder top 21 of feeder 18 and symmetrical to first conductor 20 with respect to a phantom plane extending through feeder 18.

First feeder top 19 is placed closest to grounding subject 17 among other elements of first conductor 20, and second feeder top 21 is placed closest to grounding subject 17 among other element of second conductor 22. This structure also allows suppressing the electromagnetic coupling between grounding subject 17 and first side 23 of first conductor 20 as well as first side 26 of second conductor 22. Grounding subject 17 can thus improve its reflecting function. As a result, the antenna directionality along the direction of leaving away from grounding subject 17 can be improved.

Figure 2:
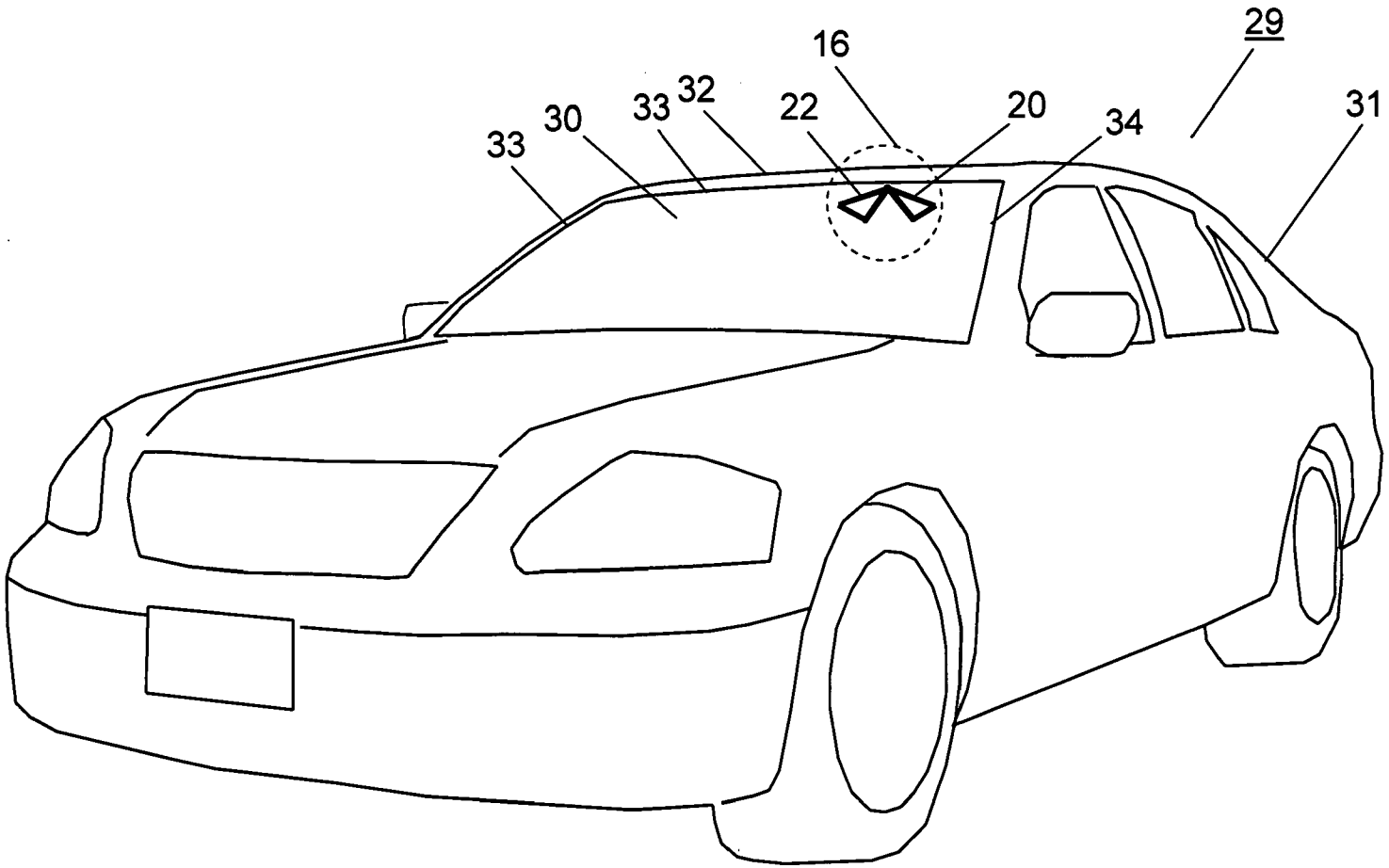
FIG. 2 shows a vehicle on which the antenna device in accordance with the first embodiment is mounted.

Next, the case where first conductor 20 and second conductor 22 are affixed to front windshield 30 of vehicle 29 is described with reference to FIG. 2.

Grounding subject 17 shown in FIG. 1 forms, e.g. roof plate 32 among the elements of the metallic body of vehicle 29. First conductor 20 and second conductor 22 are affixed to windshield 30 such that first feeder top 19 and second feeder top 21 are placed closest to border line 33 between roof plate 32 and windshield 30. First conductor 20 and second conductor 22 are affixed to windshield 30 such that the symmetry axis extending through feeder 18 becomes substantially vertical with respect to border line 33 between roof plate 32 and windshield 30. The distance between antenna device 16 and roof plate 32 is smaller than the distance between antenna device 16 and other elements of metallic body 31, e.g. side-frame 34 of vehicle 29.

The foregoing structure allows suppressing the electromagnetic coupling between the roof plate of vehicle 29 and first side 23 of first conductor 20 as well as first side 26 of second conductor 22, so that roof plate 32 can improve its reflecting function. As a result, the antenna directionality along the direction of leaving away from roof plate 32 can be improved. In other words, the antenna directionality toward ahead of vehicle 29 is improved. When antenna device 16 mounted to vehicle 29 receives a digital television broadcasting while vehicle 29 moves, it sometimes receives scattered waves generated in the interior of vehicle 29 as noises. This phenomenon is called multi-path fading. In such a case, an improvement of the antenna directionality in front of vehicle 29 allows suppressing the multi-path fading.

In this first embodiment, first conductor 20 and second conductor 22 are affixed to front windshield 30 of vehicle 29; however, those conductors can be affixed to any window made of glass of vehicle 29, so that the place where the conductors are to be affixed is not limited to front windshield 30. A plurality of antenna devices 16 can be placed to a plurality of windows, and reception outputs from the respective windows can be combined for diversity reception.

Embodiment 2

Figure 3:
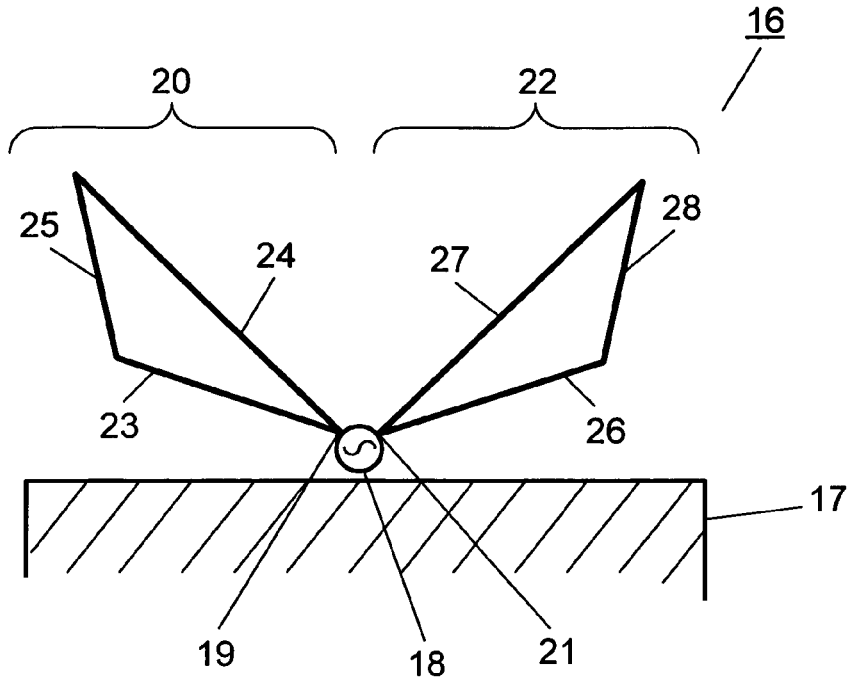
FIG. 3 shows a structure of an antenna device in accordance with a second embodiment of the present invention.

An antenna device in accordance with the second embodiment of the present invention is demonstrated with reference to FIG. 3, which shows a structure of the antenna device. Similar elements to those of the first embodiment have the same reference marks, and the description thereof are omitted, and only different points are detailed here.

The second embodiment differs from the first one in an obtuse angle formed by first side 23 (26) and third side 25 (28) of first conductor 20 (second conductor 22). This structure allows second side 24 of first conductor 20 and second side 27 of second conductor 22, both elements being further away from grounding subject 17, to have longer sides than first side 23 and first side 26 respectively, both elements being closer to grounding subject 17. In other words, a longer conductor leaves further away from grounding subject 17, so that the electromagnetic coupling between grounding subject 17 and first conductor 20 as well as second conductor 22 can be more suppressed. Grounding subject 17 can thus additionally improve its reflecting function. As a result, the antenna directionality along the direction of leaving away from grounding subject 17 can be further improved.

Embodiment 3

Figure 4:
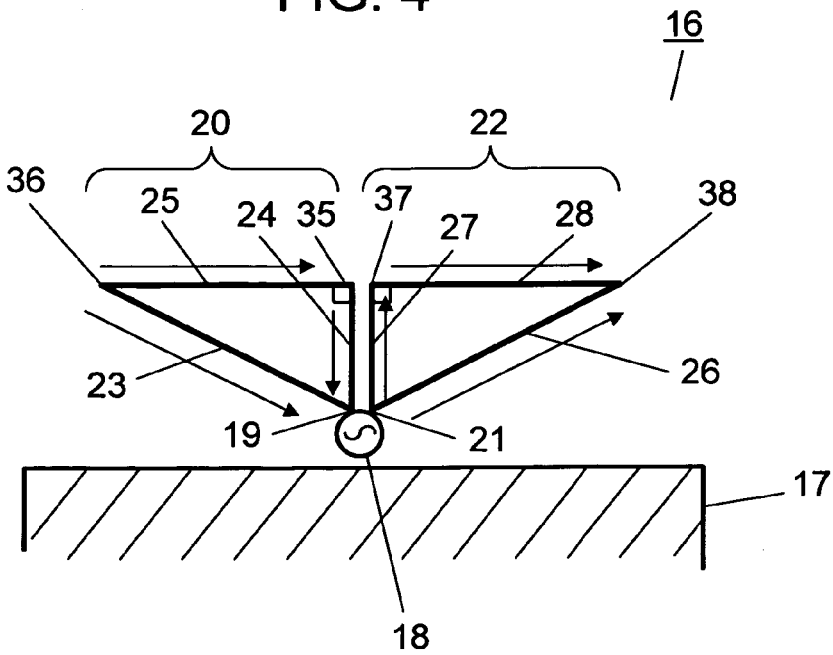
FIG. 4 shows a structure of an antenna device in accordance with a third embodiment of the present invention.

An antenna device in accordance with the third embodiment of the present invention is demonstrated with reference to FIG. 4, which shows a structure of the antenna device. Similar elements to those of the first embodiment have the same reference marks, and the description thereof are omitted, and only different points are detailed here.

Antenna device 16 shown in FIG. 4 is a balanced antenna comprising the following elements:

feeder 18;

first conductor 20 shaping like a looped and right-angled triangle coupled to feeder 18; and second conductor 22 symmetrical to first conductor 20 with respect to symmetric axis extending through feeder 18.

First conductor 20 is formed of first right-angled apex 35, first feeder top 19 coupled to feeder 18, and first acute angle apex 36 other than first right-angled apex 35 and first feeder top 19. Second conductor 22 is similarly formed of second right-angled apex 37, second feeder top 21 coupled to feeder 18, and second acute angle apex 38 other than second right-angled apex 37 and second feeder top 21. Second side 24 of first conductor 20 is generally in parallel with second side 27 of second conductor 22.

Antenna device 16 discussed above is placed, e.g. such that third side 25 of first conductor 20 and third side 28 of second conductor 22 are generally in parallel with grounding subject 17, and also feeder 18 is placed closest to grounding subject 17. Antenna device 16 is placed, e.g. on the front windshield of a car such that third side 25 of first conductor 20 and third side 28 of second conductor 22 are generally in parallel with the border line between grounding subject 17, i.e. the roof plate of the car, and the windshield.

Reception of signals at antenna device 16 in accordance with the third embodiment is demonstrated hereinafter with reference to FIG. 4. A reception current running through first conductor 20 and second conductor 22 is generally similar to that in the first embodiment. The second embodiment differs from the first embodiment in the currents running opposite to each other as shown in FIG. 4 with the arrow marks along second side 24 of first conductor 20 and second side 27 of second conductor 22. This structure allows the reception current through second side 24 and that through second side 27 to cancel out each other, so that both of these sides 24 and 27 can work as transmission lines.

Antenna device 16 in accordance with the third embodiment has two resonance frequencies f1, f2 different from each other, so that it has a wider antenna fractional bandwidth. This is a similar advantage to that of the antenna device in accordance with the first embodiment. The antenna fractional bandwidth used in this description can be calculated by finding the frequency range in which antenna VSWR characteristics becomes not greater than 3 based on an antenna impedance normalized by the resonance frequency of the antenna. VSWR is an abbreviation of voltage standing wave ratio, and an index how much the energy supplied to the antenna is radiated without being reflected due to mismatching between the antenna and the transmission line. In general, antenna VSWR characteristics is set not greater than 3 in designing the antenna.

The antenna fractional bandwidth of antenna device 16 changes depending on angles of first acute angle apex 36 and second acute angle apex 38. The changes of this antenna fractional bandwidth are detailed hereinafter with reference to specific instances.

Figure 5:
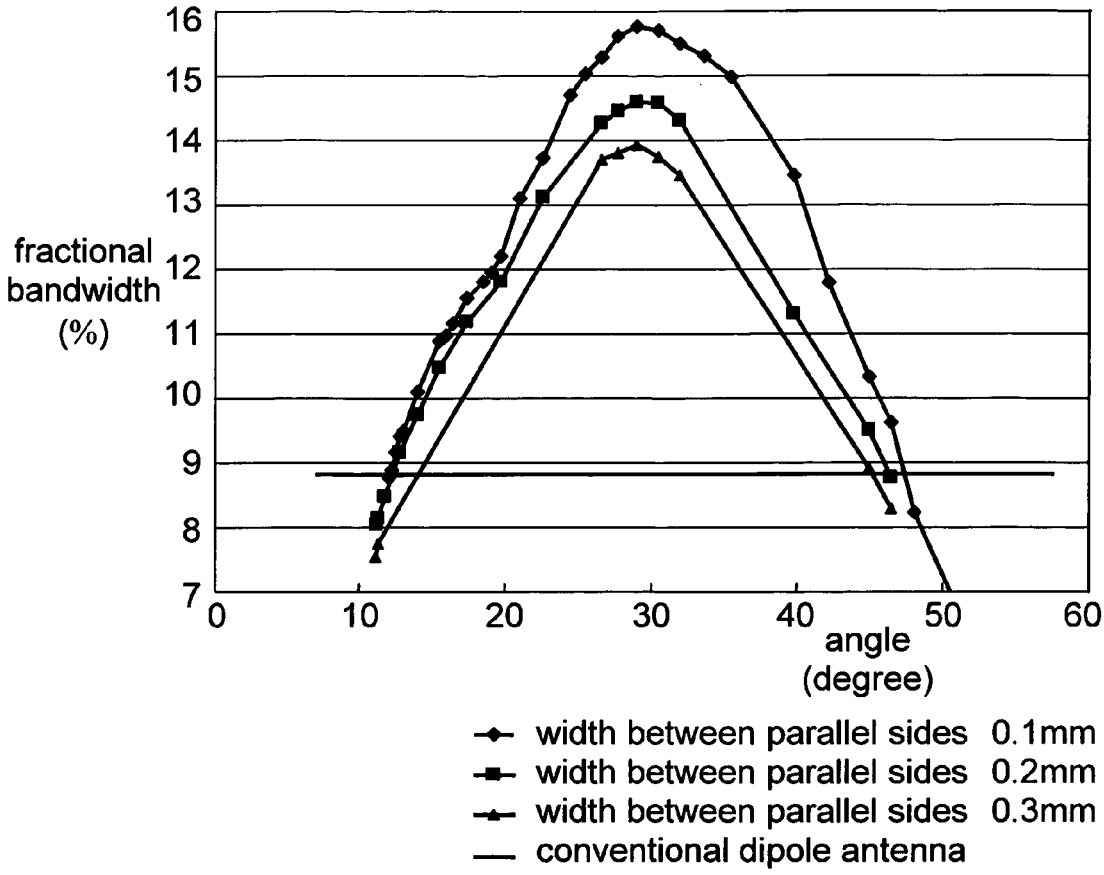
FIG. 5 shows relations between an antenna fractional bandwidth and a first acute angle apex as well as a second acute angle apex in accordance with the third embodiment.

FIG. 5 shows relations between the antenna fractional bandwidths and the angles of first acute angle apex 36 as well as those of second acute angle apex 38. The data are measured in the following conditions:

- grounding subject 17 being apart from feeder 18 by 15 mm;
- the distance between second side 24 of first conductor 20 and second side 27 of second conductor 22, i.e. the width between the parallel sides, being changed 0.1 mm, 0.2 mm, 0.3 mm; and
- the length of second sides 24 and 27 being 25 mm each.

Figure 10:
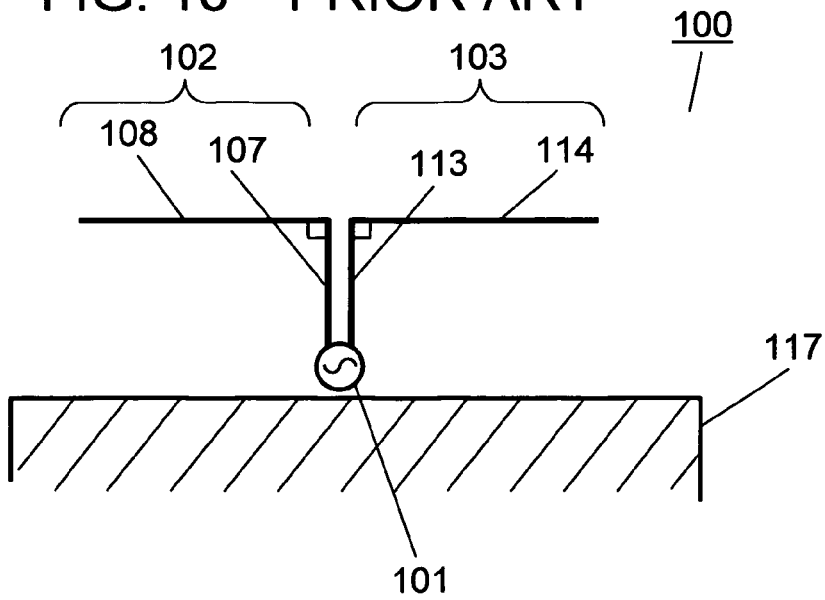
FIG. 10 PRIOR ART
FIG. 10 shows a structure of another conventional antenna device.

FIG. 5 also shows the fractional bandwidth of the conventional dipole antenna shown in FIG. 10 for a comparison purpose. The data of this conventional dipole antenna are measured in the following condition:

- grounding subject 117 being apart from feeder 101 by 15 mm;
- second side 107 of first conductor 102 being apart from second side 113 of second conductor 103 by 0.1 mm;
- the length of second sides 107 and 113 is 25 mm each; and
- the length of third side 108 of first conductor 102 and third side 114 of second conductor 103 is 43.25 mm each.

In the foregoing conditions, the fractional bandwidth of the conventional antenna shown in FIG. 10 stands at 8.8%, so that the dipole antenna has a constant fractional bandwidth regardless of first acute angle apex 36 and second acute angle apex 38 which are shown on the X-axis, and as shown in FIG. 5 the graph of the dipole antenna shows a horizontal straight line.

FIG. 5 tells that the angles of first acute angle apex 36 and second acute angle apex 38 falling into the range of 12-48 degrees allow the antenna device to obtain the characteristics better than that of the conventional dipole antenna. More specifically, the angles of first acute angle apex 36 and second acute angle apex 38 falling into the range of 20-40 degrees allow the antenna device to obtain the further wider antenna fractional bandwidth.

First side lengths 23 and 26 leave further away from third side lengths 25 and 28 respectively at greater angles than 20 degrees of first acute angle apex 36 and second acute angle apex 38. As a result, the antenna fractional bandwidth becomes wider.

On the other hand, first sides 23 and 26 approach to a line in parallel to the bottom side at smaller angles than 40 degrees of first acute angle apex 36 and second acute angle apex 38. A vector resolution of the reception current running through first side 23 of first conductor 20 into components parallel and vertical with respect to the bottom side results in a smaller vertical component. The same phenomenon can be observed on first side 26 of second conductor 22. The vertical vector component of the current running through first side 23 and that of first side 26 run oppositely to each other, so that they cancel out each other. The smaller vertical vector component is thus preferable, which improves radiation characteristics of first sides 23 and 26, and then widens the antenna fractional bandwidth.

Angle of 30 degrees at first acute angle apex 36 as well as second acute angle apex 38 gives the maximum fractional bandwidth to the antenna.

First conductor 20 and second conductor 22 can be symmetrical with respect to a plane instead of a line.

Embodiment 4

Figure 6:
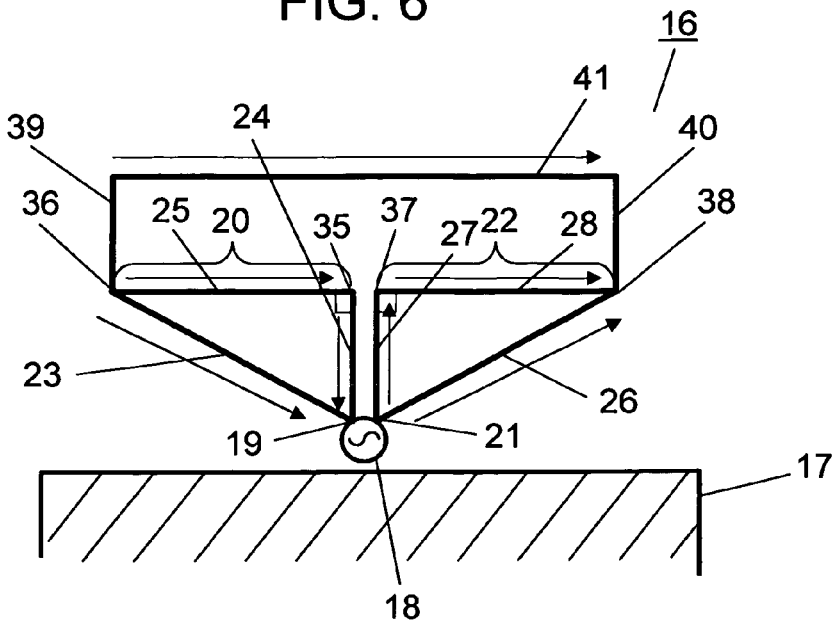
FIG. 6 shows a structure of an antenna device in accordance with a fourth embodiment of the present invention.

Antenna device 16 in accordance with the fourth embodiment is demonstrated with reference to FIG. 6, which shows a structure of antenna device 16 used in the fourth embodiment. This fourth embodiment is roughly similar to the third embodiment, however the fourth embodiment differs from the third one in the following point: Antenna device 16 additionally includes the following elements:

- first parallel line 39 substantially in parallel with second side 24 of first conductor 20 and a first end of line 39 is coupled to first acute angle apex 36;
- second parallel line 40 substantially in parallel with second side 27 of second conductor 22 and a first end of line 40 is coupled to second acute angle apex 38; and
- vertical line 41 connecting a second end of first line 39 to a second end of line 40 and substantially vertical with respect to both of line 39 and line 40.

Reception of signals at antenna device 16 in accordance with the fourth embodiment is demonstrated hereinafter with reference to FIG. 6.

A reception current runs through first conductor 20 and second conductor 22 similarly to the third embodiment. As shown in FIG. 6, the reception current helps vertical line 41 in receiving signals and runs in the same direction as those running through third sides 25 and 28. This phenomenon is a result of employing the operating principle of the folded dipole antenna, which is formed of two or more than two dipole antennas placed in parallel with each other. The tips of these dipole antennas are connected to each other, and one of the dipole antennas is fed from the center between the first and the second conductors 20, 21. This structure allows a current to run through two dipole antennas of a half wavelength equally with the same phase.

The structure discussed above apparently includes triangular dipole antennas, having a wide bandwidth, coupled to respective dipole antennas, so that antenna device 16 can improve its radiation characteristics and have a further wider antenna fractional bandwidth.

Embodiment 5

Figure 7:
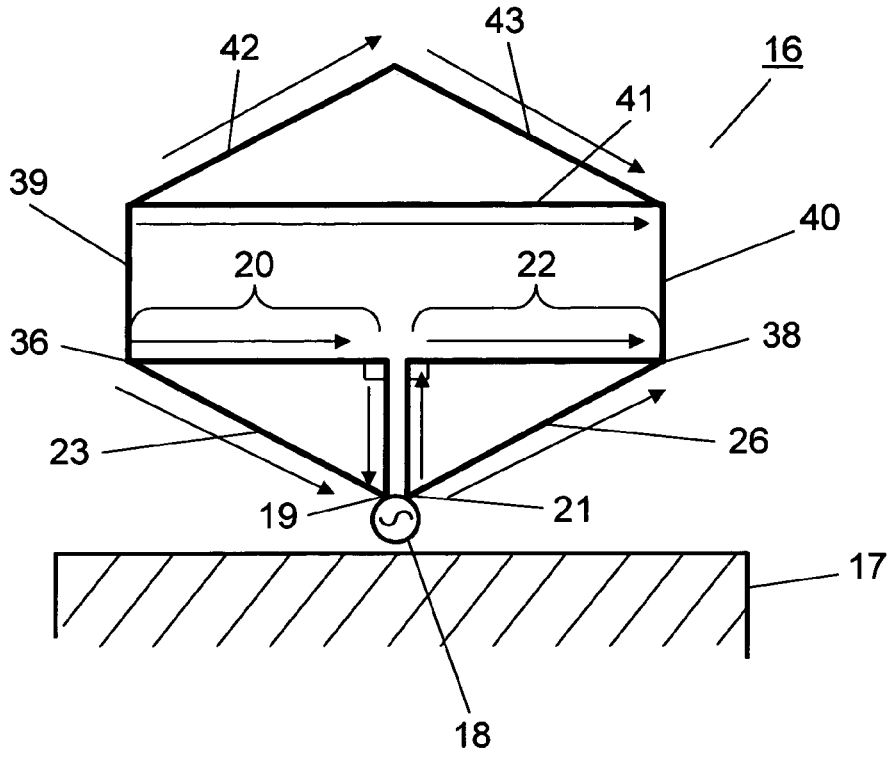
FIG. 7 shows a structure of an antenna device in accordance with a fifth embodiment of the present invention.
Figure 8:
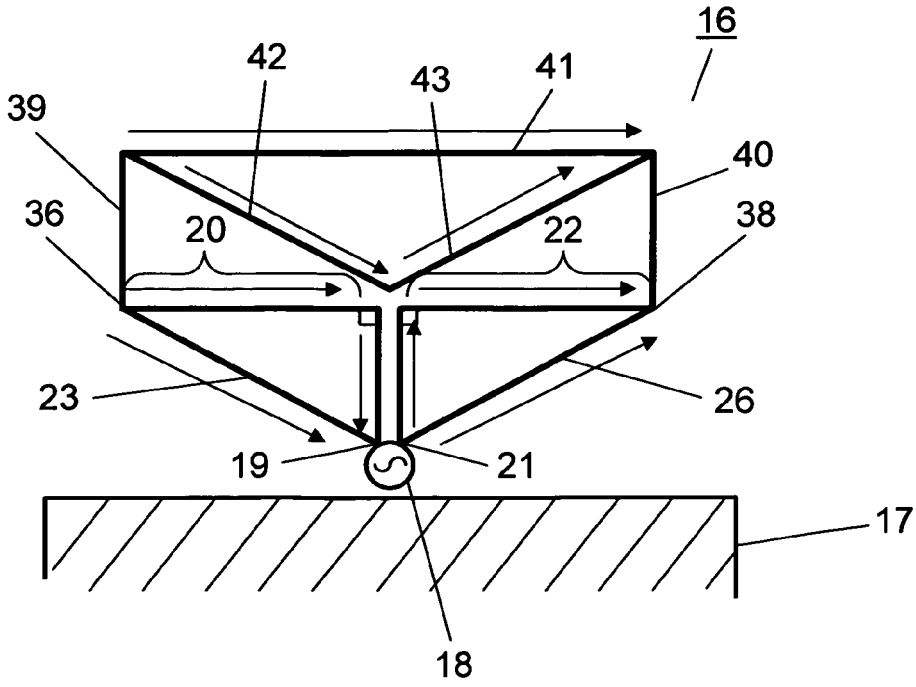
FIG. 8 shows a structure of another antenna device in accordance with the fifth embodiment of the present invention.
Figure 9:
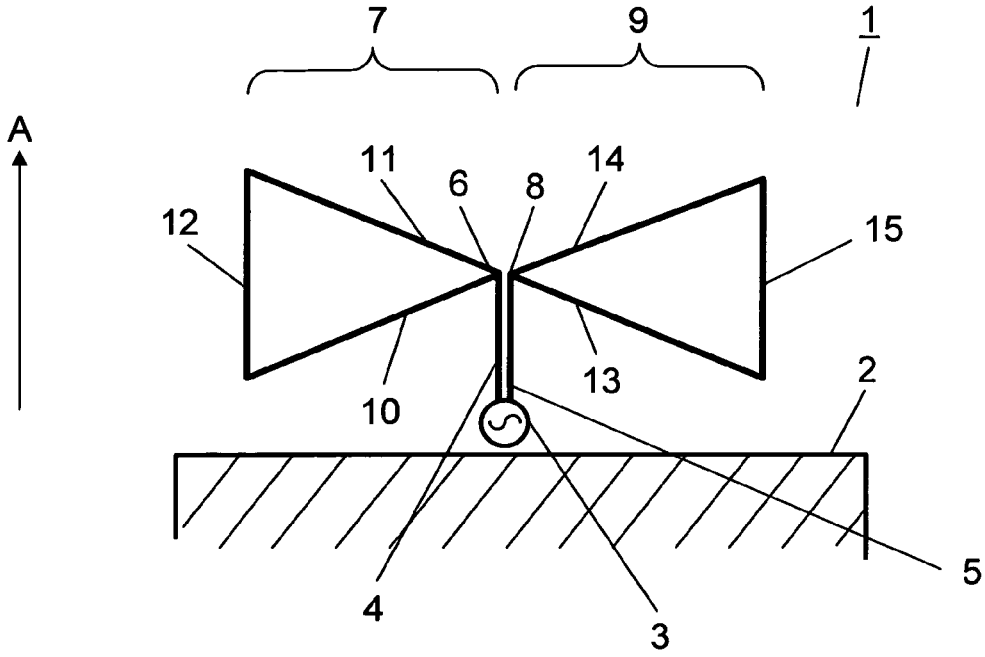
FIG. 9 PRIOR ART
FIG. 9 shows a structure of a conventional antenna device.

Antenna device 16 in accordance with the fifth embodiment is demonstrated with reference to FIGS. 7 and 8, which show structures of antenna device 16 used in the fifth embodiment. This fifth embodiment is roughly similar to the third and fourth embodiments, however the fifth embodiment differs from the third and fourth ones in the following point:

Antenna device 16 in accordance with the fifth embodiment additionally includes the following elements:

first slant side 42 coupled to the point of intersection between first parallel line 39 and vertical line 41; and second slant side 43 coupled to the point of intersection between second parallel line 40 and vertical line 41.

A substantial isosceles triangle is formed of these two slant sides and vertical line 41 as the bottom side.

Next, a signal reception of foregoing antenna device 16 in accordance with this fifth embodiment is demonstrated with reference to FIGS. 7 and 8. A reception current runs through first conductor 20, second conductor 22 and vertical line 41 similarly to the third and fourth embodiments. The reception current running through first slant side 42 runs from the point of intersection between first parallel line 39 and vertical line 41 toward the point of intersection between first slant side 42 and second slant side 43. The reception current running through second slant side 43 runs from the point of intersection between first slant side 42 and second slant side 43 toward the point of intersection between second parallel line 40 and vertical line 41.

The presence of first and second sides 42, 43 in antenna device 16 allows widening the fractional bandwidth of antenna device 16.

What is claimed is:

1. An antenna device comprising:

a grounding subject;

a feeder insulated from the grounding subject;

a first conductor shaping like substantially a looped triangle and coupled to the feeder at a first feeder top; and a second conductor substantially symmetric to the first conductor with respect to a phantom line extending through the feeder and coupled to the feeder at a second feeder top;

wherein the first feeder top is placed closest to the grounding subject among other elements of the first conductor, and the second feeder top is placed closest to the grounding subject among other elements of the second conductor.

2. The antenna device of claim 1, wherein the first conductor includes:

a first side of which first end extending from the first feeder top;

a second side, of which first end extending from the first feeder top, placed away further than the first side from the grounding subject; and a third side connecting a second end of the first side to a second end of the second side;

wherein the first side and the third side of the first conductor form an obtuse angle.

3. An antenna device comprising:

a feeder;

a first conductor shaping like substantially a looped right-angled triangle and coupled to the feeder; and a second conductor substantially symmetric to the first conductor with respect to one of a phantom line and a phantom plane extending through the feeder;

wherein the first conductor includes:

a first right-angle apex;

a first feeder top coupled to the feeder; and a first acute angle apex other than the first right-angle apex and the first feeder top, wherein the second conductor includes:

a second right-angle apex;

a second feeder top coupled to the feeder; and a second acute angle apex other than the second right-angle apex and the second feeder top, wherein a side of the first conductor, which side includes the first right-angle apex and the first feeder top, is in substantially parallel with a side of the second conductor, which side includes the second right-angle apex and the second feeder top.

4. The antenna device of claim 3, wherein angles of the first acute angle apex and the second acute angle apex fall into a range from 12 degrees to 48 degrees.

5. The antenna device of claim 3 further comprising:

a first parallel line, of which first end is coupled to the first acute angle apex, substantially parallel with the second side of the first conductor;

a second parallel line, of which first end is coupled to the second acute angle apex, substantially parallel with the second side of the second conductor; and a vertical line connecting a second end of the first parallel line to a second end of the second parallel line, and substantially vertical with respect to the first parallel line and the second parallel line.

6. The antenna device of claim 5 further comprising:

a first slant side coupled to a point of intersection between the first parallel line and the vertical line; and a second slant side coupled to a point of intersection of the second parallel line and the vertical line, wherein a substantial isosceles triangle is formed of the first slant side, the second slant side and the vertical line as a bottom side of the triangle.

7. An electronic apparatus comprising:

a grounding subject;

a feeder insulated from the grounding subject;

a first conductor shaping like substantially a looped triangle and coupled to the feeder at a first feeder top;

a second conductor substantially symmetric to the first conductor with respect to one of a phantom line or a phantom plane extending through the feeder and coupled to the feeder at a second feeder top;

a radio circuit coupled to the feeder; and a display section coupled to the radio circuit, wherein the first feeder top is placed closest to the grounding subject among other elements of the first conductor, and the second feeder top is placed closest to the grounding subject among other elements of the second conductor.

8. A vehicle comprising:

a sheet of glass equipped with an antenna device; and a metallic body disposed around the sheet of glass, wherein the antenna device includes:

a feeder insulated from the metallic body;

a first conductor shaping like substantially a looped triangle and coupled to the feeder at a first feeder top;

a second conductor substantially symmetric to the first conductor with respect to a phantom line extending through the feeder and coupled to the feeder at a second feeder top;

a radio circuit coupled to the feeder; and a display section coupled to the radio circuit, wherein the first feeder top is placed closest to the metallic body among other elements of the first conductor, and the second feeder top is placed closest to the metallic body among other elements of the second conductor.

9. The vehicle of claim 8, wherein the sheet of glass is a front windshield of the vehicle, and the metallic body is a roof plate of the vehicle.

* * * * *